United States Patent [19]

Toedtli

[11] 4,207,712

[45] Jun. 17, 1980

[54] BLADE STRUCTURE FOR CENTRIFUGAL WHEEL

[75] Inventor: Sergej Toedtli, Schaffhausen, Switzerland

[73] Assignee: Georg Fischer AG, Switzerland

[21] Appl. No.: 956,288

[22] Filed: Oct. 31, 1978

[30] Foreign Application Priority Data

Nov. 17, 1977 [CH] Switzerland ..... 14039/77

[51] Int. Cl.[2] ..... B24C 5/06

[52] U.S. Cl. ..... 51/434; 51/435

[58] Field of Search ..... 51/432, 434, 435; 241/275; 403/381; 416/187, 219 R, 219 A, 220 R, 220 A

[56] References Cited

U.S. PATENT DOCUMENTS

| | | | |
|---|---|---|---|
| 3,241,266 | 3/1966 | Bowling | 51/434 |
| 3,683,556 | 8/1972 | Leliaert | 51/434 |
| 3,785,105 | 1/1974 | Freeman | 51/434 |
| 3,977,515 | 8/1976 | Lewoczko | 403/381 X |
| 4,069,025 | 1/1978 | Macmillan | 51/434 |

FOREIGN PATENT DOCUMENTS

| | | | |
|---|---|---|---|
| 834340 | 3/1952 | Fed. Rep. of Germany | 51/434 |
| 2437493 | 2/1976 | Fed. Rep. of Germany | 51/432 |

*Primary Examiner*—Gary L. Smith

*Attorney, Agent, or Firm*—Roylance, Abrams, Berdo & Farley

[57] ABSTRACT

A throwing wheel for centrifugally propelling solid material, such as abrasive grit, has discs with grooves to hold a plurality of uniformly distributed blades. The blades have ribs along a disc-engaging portion thereof and stop members to limit radial outward movement of the blades. The grooves or the ribs or both are tapered relative to radii of the wheel. Stop members protrude from the blades and engage stops on the discs. Fixed and movable stops are retained in such a way that at least one gap remains along the blade edge to facilitate blade removal and replacement.

10 Claims, 8 Drawing Figures

BLADE STRUCTURE FOR CENTRIFUGAL WHEEL

This invention relates to a wheel for centrifuging solid material, such as abrasive, and particularly to a blade and blade mounting structure therein.

BACKGROUND OF THE INVENTION

It is known to provide a rotatably wheel structure for propelling abrasive grit or the like radially outwardly thereof, the grit being supplied to a central opening in the rotatable wheel structure and propelled outwardly by the rotary movement of blades mounted on the wheel. Because of the destructive nature of the material being handled, it is necessary to replace the blades from time-to-time, and various assemblies have been developed to permit such replacement.

One structure of this general type is shown in German Pat. No. 21 15 354, (which corresponds to U.S. Pat. No. 3,745,711) in which the blades are inserted from outside the wheel and where the wheel has rotatable stops. Stops which can be plugged in are shown in Swiss Pat. No. 352,923, (which corresponds to U.S. Pat. No. 2,819,562) and in either of these cases, marginal strips along the edges of the blades and the cooperative grooves in the wheels are formed with parallel sides. During the operation of the wheels, the abrasive or blasting material being propelled thereby is deposited in the cracks of the grooves between the discs and the blades, leading to a wedging of the grains of the blasting medium in these cracks. This complicates and makes difficult the dismantling of the blades which are, as indicated, subjected to considerable wear. Often it is necessary to dismantle the blades by striking the structure repeatedly with a hammer since it is necessary to extract the blades from the entire length of the grooves.

This is detrimental to the wheel itself, and particularly to its mounting. In addition, the space in the center of the wheel is very limited for the task of removing the blades. Moreover, the blades, the throwing surfaces of which consist of hard metal, must not be damaged by such hammer blows since, in that case, the blades will be damaged and further use of the opposite surface, in cases where the blade is reversible, is made impossible. The Swiss Pat. No. 352,923 shows recesses on the lateral strips of the blades which were intended to improve the removal, but it has developed in practice that the recesses or pockets are similarly filled with blasting material during the operation, and the grains of the material are compressed in such a way that no considerable improvement of the blade removal was achieved.

Other wheels of the general type discussed herein have been known wherein the blades are inserted from the center of the fly wheel into the grooves, the blades having fixed stops on the blade or on the wheel disc. Examples of these are found in German Pat. No. 21 12 497 (which corresponds to U.S. Pat. No. 3,683,556) and German Offenlegunsschrift No. 26 34 198 (which corresponds to U.S. Pat. No. 4,069,025). Because of the grooves and lateral strips which are formed in parallel with each other, the above-described difficulties occur when attempting to remove the blades from the outside to the inside. Also, the sections of each lateral strip, described in OS No. 26 34 198, do not simplify the blade removal for the reasons mentioned in connection with the Swiss patent. Whenever such sections are selected very large relative to the groove length, the contact surface of the blade decreases so much that in the case of considerable peripheral force, excessive surface pressures with consequent damage of the contact surfaces has been found to develop.

BRIEF DESCRIPTION OF THE INVENTION

An object of the present invention is to provide a material propelling wheel for a centrifugal apparatus wherein the support of the blades in one or more discs is developed such that removal thereof with minimum expenditure of energy and force is facilitated, and wherein the use of movable as well as fixed stops is made possible.

Briefly described, the invention comprises an improved blade mounting structure for a centrifugal material propelling wheel of the type having first and second discs, spacer means for maintaining the discs in substantially parallel spaced relationship, means defining a plurality of uniformly distributed radially extending grooves in the inwardly facing surfaces of the discs, a plurality of replaceable blades insertable in the grooves, and means coupled to one of the discs for rotating the wheel, the improvement wherein each of the blades comprises an elongated body having a disc-engaging end portion and a portion protruding beyond the periphery of the discs, the disc-engaging end portion having a plurality of longitudinally extending ribs, and a laterally protruding stop member fixedly attached thereto; and wherein each of the radially extending grooves includes stop means in at least one of the discs for engaging the protruding stop member to prevent movement of the associated one of the blades radially outwardly of the wheel; and wherein at least one of each of the ribs and grooves is formed with a taper in at least one plane passing through the longitudinal axis of each blade, whereby, when each of the blades is installed in a groove with the stop member engaged with the stop means, at least one of the ribs remains spaced from the adjacent surface of the associated groove.

Forming the grooves or the ribs, or both, permits simple dismantling of the centrifugal blades which have become firmly jammed through blasting agents without any special tools and without damage to the grooves or to the blades themselves.

In order that the manner in which the foregoing and other objects are attained in accordance with the invention can be understood in detail, particularly advantageous embodiments thereof will be described with reference to the accompanying drawings, which form a part of this specification, and wherein.

Figure 1:
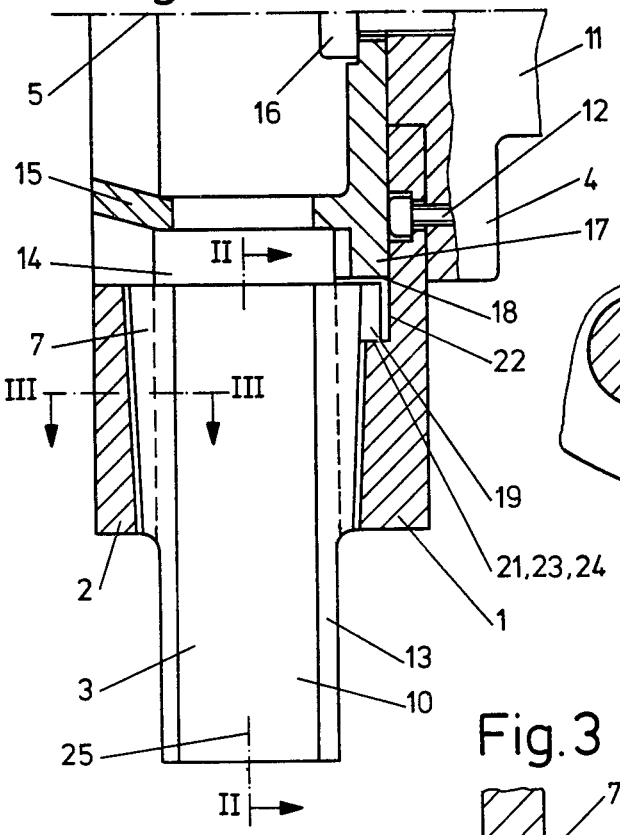
FIG. 1 is a partial side elevation, in partial section, of approximately one-half of a wheel structure showing a blade formed and mounted in accordance with an embodiment of the invention.
Figure 2:
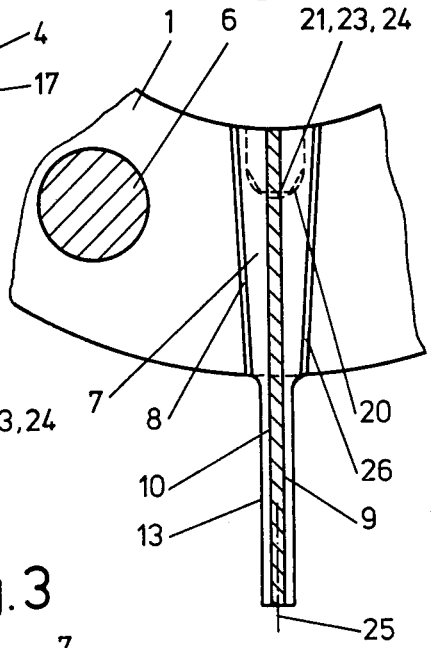
FIG. 2 is a partial end view, in partial section, along line II—II of FIG. 1.

As shown in FIGS. 1 and 2, the apparatus includes a throwing wheel constructed using two discs which can be operated in either rotational direction. The wheel includes an inside, or back, wheel disc 1, an outside, or front, disc 2 and a plurality of centrifugal blades 3 which are uniformly distributed about the periphery of the wheel formed by the discs. Only one blade 3 is illustrated in FIGS. 1 and 2, but it will be understood that the remainder of the wheel structure on the opposite side of rotational axis 5 is substantially identical to that shown and that a plurality of blades, e.g., 6 or 8, are uniformly mounted in the wheel structure in the manner which will be described in detail. Disc 1 is fixedly attached by screws 12 by a flange 4 to a shaft 11 which shaft is driven by a motor, not shown, so that the shaft and wheel rotate about axis 5. Disc 2 is fixedly connected to disc 1 by a plurality of uniformly distributed spacing pins 6.

Blades 3 have propelling surfaces 9, normally on both sides, and are provided at one end thereof with longitudinally extending lateral ribs or strips 7 which engage with inwardly facing radially extending grooves 8 formed in the inwardly facing surfaces of discs 1 and 2. Ribs 7 extend along enough of the length of the blades so as to extend substantially up to the outer periphery of discs 1 and 2, and the blades additionally have a portion 10 which projects beyond the peripheral limits of the discs. That portion of the blades having ribs 7 can thus be referred to as the disc-engaging portion of the blade structure. The throwing surfaces 9 are provided primarily along portion 10 of each blade structure, this portion having upstanding edges 13 which serve for guiding the blasting agent. The inside end of each of blades 3 forms the outer limit of a central generally cylindrical volume 14 in which a rotor 15 and a control basket, not illustrated in detail, are provided. The rotor 15 is fixedly attached to shaft 11 by a centrally disposed screw 16, the rotor being provided with a flange 17, the peripheral surface 18 of which forms a stop surface to prevent radial inward movement of blades 3. Because the diameter of the volume 14 is greater than the length of the disc-engaging portion including rib 7, the blades 3 can be moved radially inwardly of the discs, after removal of the control basket and rotor 15, for removal of the blades from the wheel structure.

Figure 3:
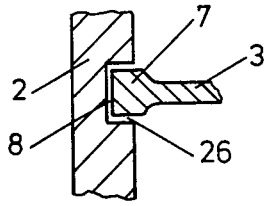
FIG. 3 is an enlarged detail view, in section, along line III—III of the FIG. 1.

Each blade 3 in the embodiment of FIGS. 1 and 2 is provided on the outside of one of ribs 7 with a protruding member 19. Member 19 is a stop member having a rectangular cross section and extends from the inner end of the blade partially along the length of rib 7. The radially outward end of protruding member 19, facing the discharge end of the blade, is formed by two converging oblique surfaces 20 and a stop surface 21 which extends perpendicular to the direction of insertion. On disc 1, the disc which is attached to the drive shaft, and at the radial inward end of groove 8, there is a recess 22, the outside arch-shaped end of which constitutes a contact or abutment surface 23. This contact surface, together with the stop surface 21 of member 19, forms a fixed stop means 24 which limits the path of insertion and holds the blade 3 from moving radially outwardly. As a result of the arrangement of the fixed stops 24 only on disc 1 which is connected to the drive shaft, the centrifugal forces developed as a result of the rotation of blades 3 are transmitted directly from disc 1 to shaft 11 and its mounting. Naturally, the fixed stops 24 may also be disposed on both sets of ribs 7 and on both discs 1 and 2 and it is also possible to form other embodiments of stop means such as, for example, pins in the grooves of the wheel discs and recesses in the lateral ribs of the blades. As can be seen from FIG. 3, the cross section of the lateral ribs 7, as well as of the grooves 8, is formed rectangularly.

Lateral ribs 7 are formed tapering or wedge-shaped in two mutually perpendicular planes which contain the longitudinal axis 25 of blade 3 and the larger cross section of the wedge shape is at the radial inward end of blades 3. The grooves 8 are similarly tapered or wedge-shaped in the same direction, as a result of which arrangement a gap of substantially uniform width 26 is formed between the grooves 8 and ribs 7 when the blade 3 is disposed in its installed, operative position with full abutment of stop 24.

The gap at 26 is necessary for reasons of production tolerances of the cast blades 3 with the result that, with the radial outward force of the blades being taken up by the stop 24, it is assured that the centrifugal forces are absorbed by the stop 24 and not by the mating wedge relationship in grooves 8. During operation, gap 26 normally becomes filled with particles of the blasting agent, which particles become wedged therein. However, because of the tapered development of the ribs and grooves, the wedged-in particles of the blasting agent immediately fall apart as the blade is dismantled because, even in the case of a slight shifting of the blade 3 toward the inside, the gap 26 is immediately enlarged.

It is also possible to make either the grooves or the ribs with surfaces being mutually parallel.

Figure 4:
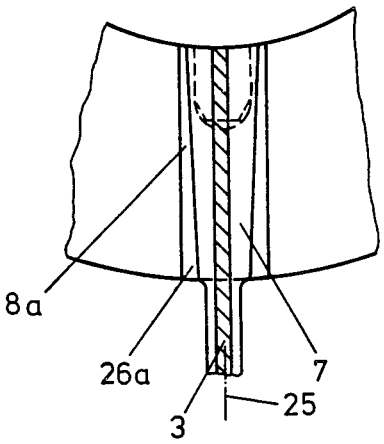
FIG. 4 is a view similar to FIG. 2 showing a further embodiment of a mounting structure in accordance with the invention.
Figure 5:
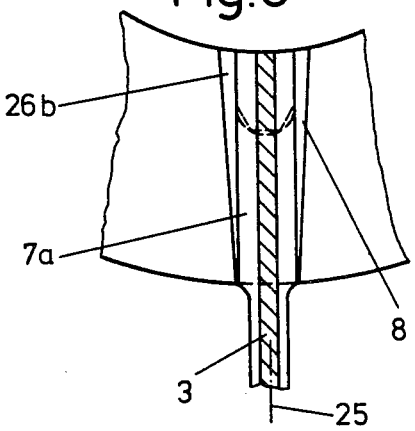
FIG. 5 is a view similar to FIGS. 2 and 4 of a further embodiment of a mounting arrangement in accordance with the invention.

FIG. 4 shows a variation of the embodiment discussed above in which the grooves 8*a* are made with parallel opposite walls and the strips 7 are formed with a taper, decreasing from the inside to the outside along the radius of the wheel. As a result of this arrangement, gap 26*a*, increasing toward the outside of the wheel, is formed. Yet another arrangement, shown in FIG. 5, exists when the ribs are formed with opposite parallel side surfaces and the groove is formed with a taper decreasing toward the outside of the wheel. Thus, a gap 26*b* is formed which increases toward the inside of the wheel.

As to the modifications of the embodiments shown here, asymmetrical combinations of tapered or straight grooves with tapered or straight strips with respect to the longitudinal axis of the blade is possible.

Figure 6:
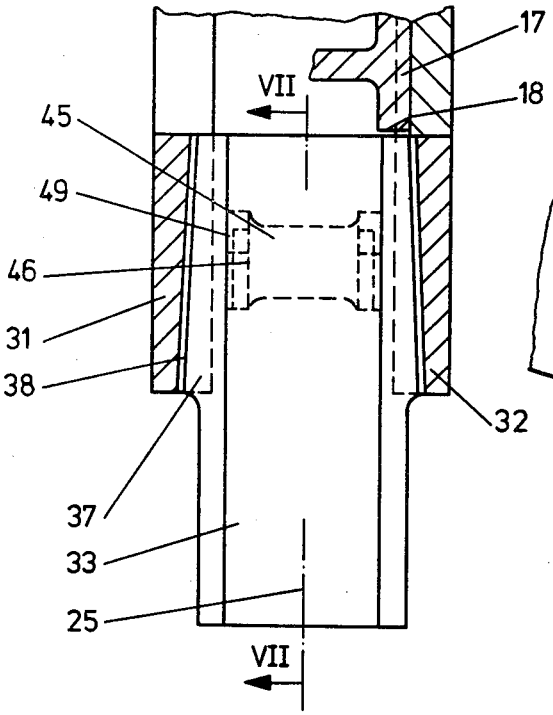
FIG. 6 is a partial side elevation, in partial section, of a further embodiment of a blade structure and mounting arrangement in accordance with the invention showing movable stop means associated therewith.
Figure 7:
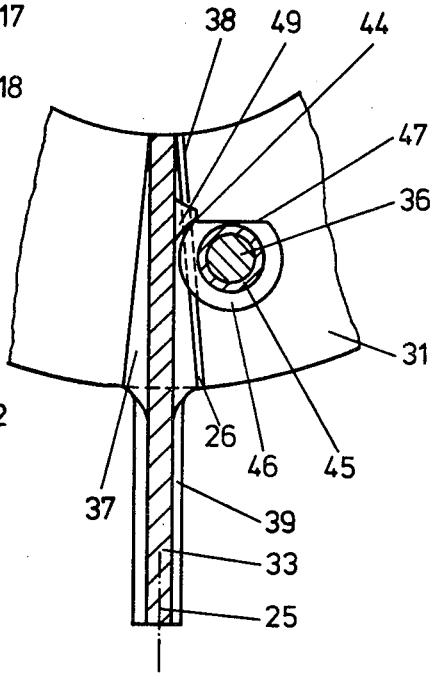
FIG. 7 is a partial end elevation, in partial section, along line VII—VII of FIG. 6.
Figure 8:
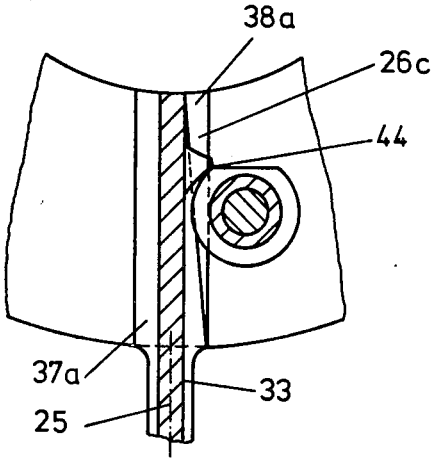
FIG. 8 is a view similar to FIG. 7 showing a further embodiment of a mounting arrangement in accordance with the invention.

In FIGS. 6–8, a further embodiment of a wheel in accordance with the invention is shown in partial sections wherein blades 33 are insertable into the wheel from the outside thereof between discs 31 and 32 and are retained against radial outward movement by movable stop arrangements 44.

The stop arrangement structure can be mounted on spacing pins 36 holding the two discs 31 and 32 in parallel spaced relationship, the stop structure including a sleeve 45 rotatably mounted on each pin 36. Sleeve 45 is provided at its opposite ends with locking cams 46, comprising enlarged flange members, each flange member having one side flattened at 47. Each blade 33 is provided with longitudinally and laterally protruding ribs 37 which are inserted into opposite grooves 38 of discs 31 and 32. Immediately adjacent ribs 37 there are two humps 49 which protrude from the material propelling surface 39 of blade 33 which, together with the locking cams 46, constitute the stop arrangement 44.

In the embodiment in accordance with FIGS. 6 and 7, the ribs 37 and grooves 38 are developed as symmetrical wedge-shaped members, symmetrical with respect to the longitudinal axis 25 of blade 33, such that the cross section of ribs 37 and grooves 38 decreases from the outside to the inside.

When assembling blades 33, the blades are inserted from the outside to the wedge-shaped grooves 38 with the flattened surfaces 47 of locking cams 46 being set so that the surfaces are parallel with the adjacent side of groove 38, until the inner ends of the blades fit against the peripheral surface 18 of flange 17. The casing 45 is then rotated until the locking cams 46 fit against the humps 49 of the blades 33, as a result of which radial outward movement of blades 33 is prevented. Simultaneously, blade 33 is pressed by the locking cams against the opposite surface of groove 38, as a result of which a gap of 26 is formed on the side of blade 33 adjacent hump 49 between groove 38 and rib 37, which gap, as has already been described, will be filled with the blasting material. As a result of the immediate enlargement of the gap which occurs as soon as extraction of the blade commence, the disengagement of the blades from the wheel structure is considerably facilitated.

In the modification shown in FIG. 8, the groove **38*a* is formed wtih parallel opposite surfaces and the lateral rib 37*a* is formed unsymmetrically with respect to the longitudinal axis 25 (i.e., the taper exists only on one side of the blade) so that the side of the lateral rib facing stop 44 is made wedge-shaped decreasing to the inside and the opposite side is parallel with the longitudinal axis 25. As a result, a wedge-shaped gap 26*c*** develops on the side adjacent the locking arrangement.

While certain advantageous embodiments have been chosen to illustrate the invention, it will be understood by those skilled in the art that various changes and modifications can be made therein without departing from the scope of the invention as defined in the appended claims.

What is claimed is:

1. A centrifugal blasting wheel comprising first and second discs having uniformly distributed, radially extending grooves in inwardly facing surfaces thereof; spacer means for maintaining said discs in substantially parallel spaced relationship; and a plurality of replaceable blades insertable in said grooves, each of said blades comprising an elongated body having a disc-engaging end portion and a portion protruding beyond the periphery of said discs, each of said disc-engaging end portions having a plurality of longitudinally extending ribs, and a laterally protruding stop member fixedly attached thereto;

stop means in at least one of said discs adjacent its grooves for engaging said protruding stop members to prevent movement of said blades radially outwardly of the wheel; and at least one of said ribs and said grooves being formed with a taper in at least one plane passing through the longitudinal axis of each blade;

whereby, when each of said blades is installed in a groove with its stop member engaged with the associated stop means, at least one of said ribs remains spaced from the adjacent surface of the associated groove.

2. A centrifugal blasting wheel according to claim 1, wherein each said stop means comprises a fixed abutment shoulder adjacent a surface of one of said grooves, and wherein said taper is formed with the smaller dimension thereof adjacent the disc periphery.

3. A centrifugal blasting wheel according to claim 2, wherein each of said blades, said ribs and said grooves are each rectangular in cross section and symmetrically tapered relative to the longitudinal axis of their associated blade.

4. A centrifugal blasting wheel according to claim 2, wherein said grooves are formed with substantially parallel opposite walls, and wherein, on each of said blades, said ribs are rectangular in cross section and are tapered on at least one side of its blade.

5. A centrifugal blasting wheel according to claim 2, wherein said stop members protrude laterally from the ribs at one edge of said blades and said fixed abutment shoulders are formed by means defining recesses adjacent said grooves in said one of said discs facing radially inwardly.

6. A ccentrifugal blasting wheel according to claim 2, wherein each of said ribs and said grooves are formed tapering in perpendicular planes containing the longitudinal axis of their blade.

7. A centrifugal blasting wheel according to claim 1, wherein said stop means include a plurality of latch members movable into engagement with said stop members, and wherein each said taper is formed with the larger dimension thereof adjacent the disc periphery.

8. A centrifugal blasting wheel according to claim 7, wherein, in each of said blades, said ribs and said grooves are each rectangular in cross section and symmetrically tapered relative to the longitudinal axis of their blade.

9. A centrifugal blasting wheel according to claim 7, wherein said grooves are formed with substantially parallel opposite walls and wherein, on each of said blades, said ribs are rectangular in cross section and are tapered on at least one side of its blade.

10. A centrifugal blasting wheel according to claim 7, wherein each of said blades includes material propelling surfaces between its ribs, and wherein each of said stop members comprises a protrusion from one of said propelling surfaces in each said disc-engaging end portion, and each of said latching members comprises a locking cam pivotally mounted between said discs.

* * * * *